US008292394B2

(12) United States Patent
Taniguchi

(10) Patent No.: US 8,292,394 B2
(45) Date of Patent: Oct. 23, 2012

(54) INKJET RECORDING APPARATUS

(75) Inventor: Hisashi Taniguchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 232 days.

(21) Appl. No.: 12/792,573

(22) Filed: Jun. 2, 2010

(65) Prior Publication Data

US 2010/0309238 A1 Dec. 9, 2010

(30) Foreign Application Priority Data

Jun. 5, 2009 (JP) ..... 2009-136367

(51) Int. Cl.
*B41J 29/38* (2006.01)

(52) U.S. Cl. ..... 347/16

(58) Field of Classification Search ..... 347/6, 7, 347/16, 104
See application file for complete search history.

(56) References Cited

U.S. PATENT DOCUMENTS

| | | | | |
|---|---|---|---|---|
| 6,168,270 | B1 * | 1/2001 | Saikawa et al. | 347/104 |
| 7,063,417 | B2 * | 6/2006 | Iwakura et al. | 347/104 |
| 7,591,467 | B2 * | 9/2009 | Terada | 271/274 |

FOREIGN PATENT DOCUMENTS

| | | | |
|---|---|---|---|
| JP | 7-205416 | A | 8/1995 |
| JP | 8-267846 | A | 10/1996 |
| JP | 2005-246727 | A | 9/2005 |

* cited by examiner

*Primary Examiner* — An Do

(74) *Attorney, Agent, or Firm* — Canon U.S.A., Inc. IP Division

(57) ABSTRACT

An apparatus includes a conveyance unit configured to convey a sheet, a carriage configured to support and cause a recording head to scan for performing an operation on the conveyed sheet, a curl amount acquiring unit configured to acquire a curl amount of the sheet when a leading edge of the sheet reaches a predetermined position, a threshold value acquiring unit configured to acquire a threshold value of an allowable curl amount when the sheet passes through the predetermined position, and a control unit configured to control the operation such that, when the acquired curl amount exceeds the threshold value, time taken from a start of the operation on the predetermined recording area to a point when the leading edge reaches the predetermined position is increased more than when the curl amount does not exceed the threshold value.

21 Claims, 14 Drawing Sheets

INKJET RECORDING APPARATUS

BACKGROUND OF THE INVENTION

1. Field of the Invention

The present invention relates to an inkjet recording apparatus that ejects ink onto a recording sheet to perform recording, and more particularly to an inkjet recording apparatus that reduces a reduction in throughput of printing.

2. Description of the Related Art

A recording apparatus, such as a printer, copying machine, and facsimile, is configured to record an image composed of a dot pattern onto a recording material such as paper or a plastic thin plate based on image information.

The recording apparatus can be classified into an inkjet type, wire dot type, thermal type, laser beam type, etc., according to a recording system. The inkjet type (inkjet recording apparatus) of these systems is configured to record an image by ejecting an ink (recording liquid) droplet from an ejection port of a recording head and allowing the ink droplet to be deposited onto the recording material.

Most of the inkjet recording apparatuses record an image using aqueous liquid ink. Therefore, after an image is formed, a recording sheet extends due to moisture contained in the ink, so that a paper fiber on a surface where the image is formed expands to produce a phenomenon in which the recording sheet is curled. When the curl is generated, discharged recording sheets might not be aligned or paper jam might be produced.

Japanese Patent Application Laid-Open No. 8-267846 discusses that, to solve the situation, a time taken for drying the ink is obtained according to a temperature, humidity, and a printing ratio, conveyance of the recording sheet after the image formation is temporarily stopped until the drying time is elapsed, and then, the recording sheet is discharged after the lapse of the drying time.

Alternatively, Japanese Patent Application Laid-Open No. 2005-246727 discusses that a mode is changed to a mode in which a paper feeding amount is relatively small according to drying time to provide the drying time, to prevent a discharged recording sheet from being curled.

Japanese Patent Application Laid-Open No. 7-205416 discusses a method in which, to provide drying time while keeping reduction in a printing speed to a minimum, a printing ratio is detected for every predetermined area and the drying time is obtained according to the printing ratio to keep the drying time to a minimum.

However, the recording apparatuses discussed in above described Japanese Patent Applications Laid-Open No. 8-267846, No. 2005-246727, and No. 7-205416 obtain ink drying time according to a temperature, humidity, and printing ratio for every predetermined area. Therefore, these apparatuses do not sufficiently reflect change in the drying time according to various conditions such as a recording mode or paper feeding structure of these apparatuses, and hence, they take much recording time in total than necessary.

SUMMARY OF THE INVENTION

According to an aspect of the present invention, an apparatus includes a conveyance unit configured to convey a sheet, a carriage configured to support and cause a recording head to scan for performing a recording operation on the conveyed sheet, a curl amount acquiring unit configured to acquire a curl amount which is generated on the sheet when a leading edge of the sheet reaches a predetermined position, based on information regarding a recording condition of a predetermined recording area of the sheet on which the recording operation is performed, a threshold value acquiring unit configured to acquire a threshold value of an allowable curl amount when the sheet passes through the predetermined position, and a control unit configured to control the recording operation such that, when the acquired curl amount exceeds the threshold value, time taken from a start of the recording operation on the predetermined recording area to a point when the leading edge of the sheet reaches the predetermined position is increased more than when the curl amount does not exceed the threshold value.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Figure 1:
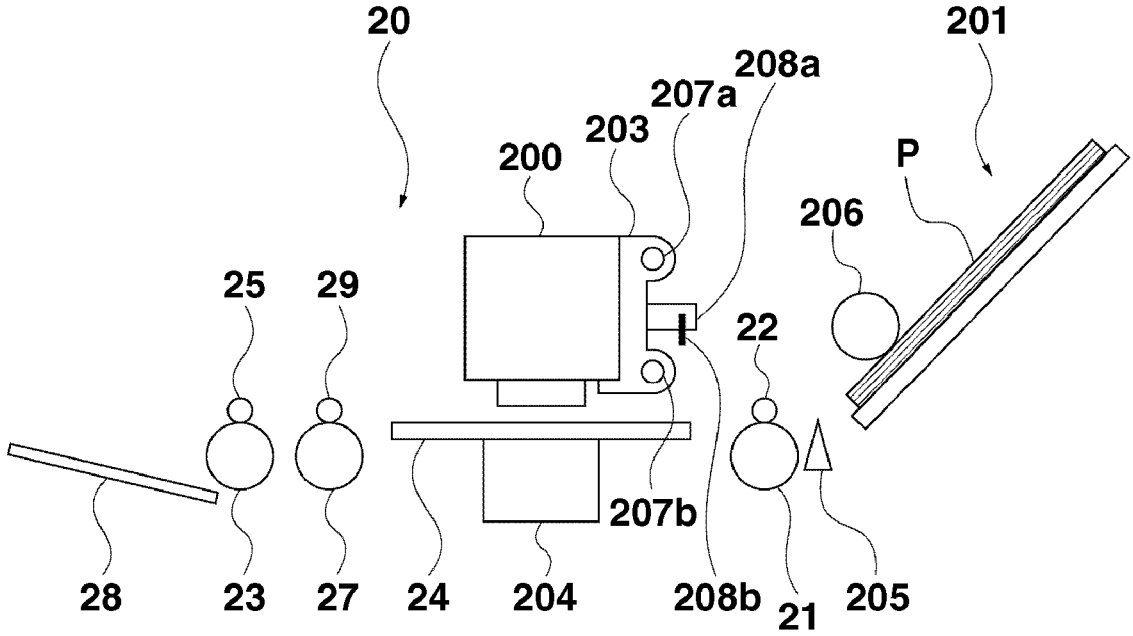
FIG. 1 is a schematic sectional view illustrating an outline of a recording apparatus according to a first exemplary embodiment of the present invention.

Various exemplary embodiments, features, and aspects of the invention will be described in detail below with reference to the drawings.

A first exemplary embodiment according to the present invention will be described below with reference to the drawings. The same reference numerals are used for the same or corresponding portions throughout the drawings.

In FIG. 1, an inkjet recording apparatus includes a paper feed unit 201 that feeds a recording sheet P into a main body of the recording apparatus, and a conveyance unit 20 that conveys the recording sheet P through the main body (e.g. a recording unit) of the recording apparatus. The inkjet recording apparatus further includes a recording mechanism unit (carriage unit) 203 that records an image (including characters and symbols) onto the recording sheet (sheet) P based on image information. The inkjet recording apparatus also includes a cleaning mechanism unit (recover mechanism unit) 204 that maintains an image quality formed by the recording mechanism unit (carriage unit) 203.

The recording sheets P stacked on the paper feed unit 201 are separated one by one by a pickup roller 206 and fed to the conveyance unit 20. A sheet detection sensor 205 is provided between a paper feed apparatus 1 and the conveyance unit 20. The sheet detection sensor 205 detects the recording sheet fed from the paper feed unit 201.

The recording sheet fed to the conveyance unit 20 is conveyed through the recording unit by friction conveyance force by a conveyance roller 21 which is a conveyance unit driven by a conveyance motor 26, and a pinch roller 22 that is pressed against the conveyance roller 21. The recording sheet is subjected to recording an image (including characters and symbols) thereon by the recording mechanism unit (carriage unit) 203 while being fed (pitch-conveyance) in the recording unit. An optical sensor 321 detects a slit formed on a code wheel attached to the conveyance roller 21 and a control circuit 300 (FIG. 2) serving as a control unit calculates a rotation amount and a rotation speed of the conveyance roller 21 from a detection signal from the optical sensor 321. These information pieces are fed back to a control driver for the conveyance motor to be controlled.

The recording sheet having the image recorded thereon is discharged to a sheet discharge tray 28 by conveying force that is caused by an operation in which the recording sheet is pinched between a sheet discharge roller 23 driven with the conveyance roller 21 and a spur 25 that is driven in cooperation with the sheet discharge roller 23.

The recording mechanism unit (carriage unit) includes a carriage 203 which is guided and supported to be capable reciprocating in a main scanning direction in the main body of the apparatus, and a recording head 200 which is supported by the carriage 203 and serves as a recording unit. The carriage 203 having the recording head mounted thereon is guided and supported to be capable of reciprocating along guide rails 207*a* and 207*b* mounted on the main body of the apparatus. Driving force of a carriage motor 322 is transmitted to the carriage 203 via a carriage belt, so that the carriage 203 reciprocates along the guide rails 207*a* and 207*b* by the driving force of the carriage motor 322. In this case, an encoder sensor 208*a* mounted on the carriage unit senses a slit formed on an encoder scale 208*b*, so that the control circuit 300 recognizes a position of the carriage 203 in the main scanning direction and the speed thereof. Since the recording operation of the recording head in synchronization with the reciprocating movement (main scanning) of the carriage and the feed (sub-scanning) of the recording material per a predetermined pitch are repeated, the recording is performed for the entire recording material.

A platen 24 is arranged by facing the recording head for supporting the recording sheet P at a stable height position. The conveyance roller 21 is positioned at an upstream side of the recording head in the conveyance direction. The pinch roller 22 is pressed against the conveyance roller 21 and moves with the conveyance roller 21. The pinch roller 22 is arranged as being offset from the conveyance roller 21 toward a downstream side in the conveyance direction. Therefore, the recording sheet P pinched between the conveyance roller 21 and the pinch roller 22 is pressed against the platen 24 in a recorded state.

The recover mechanism unit (cleaning mechanism unit) 204 eliminates clogging of the recording head in the inkjet recording apparatus to recover and maintain the recording quality in a normal (satisfactory) state. The recover mechanism unit 204 includes a pump unit that sucks or ejects ink from an ejection port, a cap unit that covers the ejection port, and a wiping unit that wipes a surface of the ejection port. The recover mechanism unit 204 is located at an end of a moving range of the carriage 203 and at an outside of an area where the recording sheet conveyed by the conveyance roller 21 passes.

The sheet discharge roller 23 is positioned at the downstream side of the recording head in the conveyance direction. The spur 25 is pressed against the sheet discharge roller 23 and moves with the sheet discharge roller 23. An auxiliary sheet discharge roller 27 assists the conveyance by the sheet discharge roller 23. A spur 29 is pressed against the auxiliary sheet discharge roller 27 and moves with the auxiliary sheet discharge roller 27. Driving force of the conveyance motor 26 is transmitted to the conveyance roller 21, the sheet discharge roller 23, and the auxiliary sheet discharge roller 27 via a transmission gear train, so that these rollers are driven to convey the recording medium P at a substantially same speed. The sheet discharge tray 28 is arranged at the downstream side of the sheet discharge roller 23 and configured to be capable of stacking the recording sheets P discharged from the conveyance unit 20.

Figure 2:
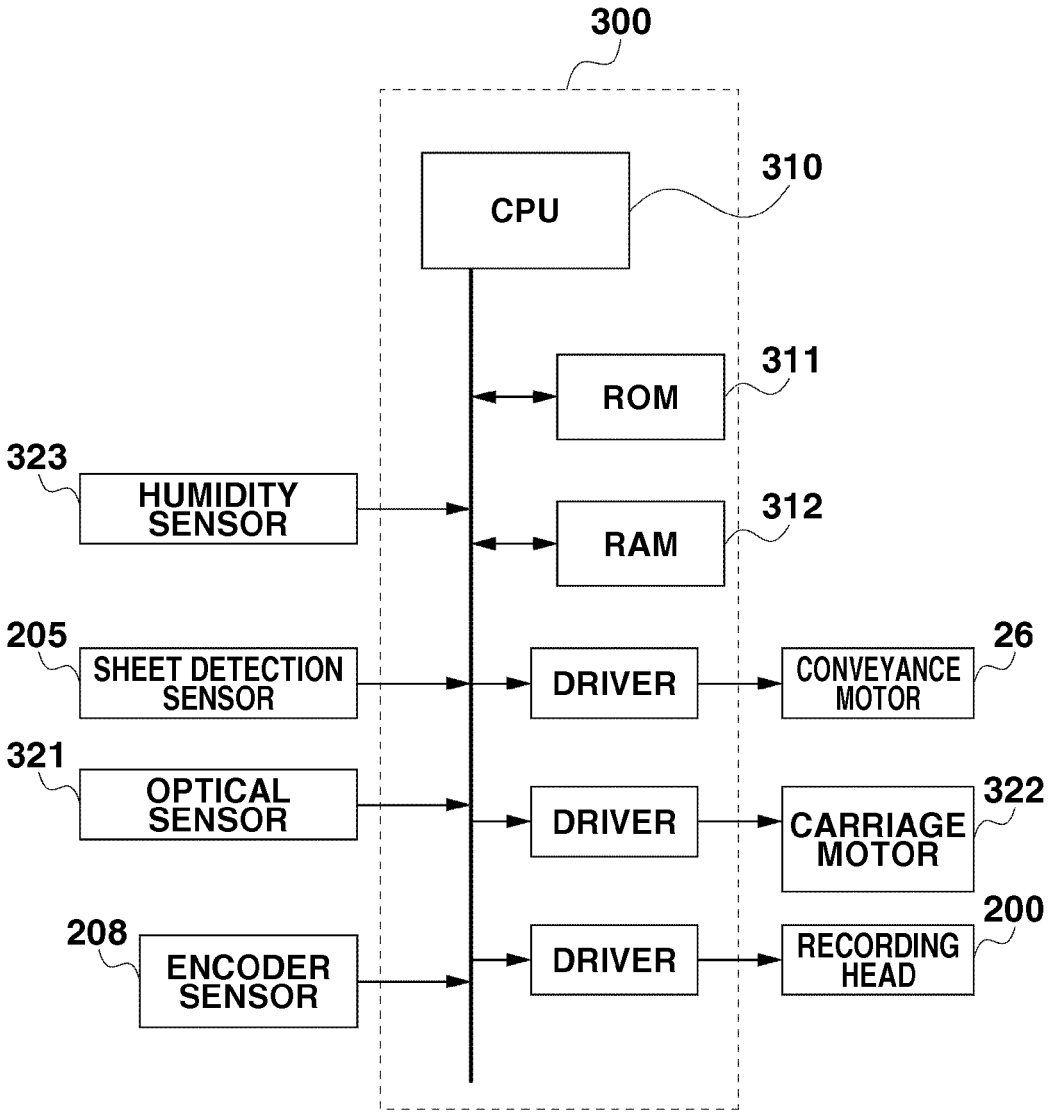
FIG. 2 is a control circuit diagram of an inkjet recording apparatus.

FIG. 2 illustrates a control circuit diagram.

The control circuit 300 serving as the control unit is provided with a central processing unit (CPU) 310 for controlling a command and determination, a read-only memory (ROM) 311 that stores a program, constant, data, and a table, a random access memory (RAM) 312 that stores data and serves as a working area, and various drivers. Pieces of information from a humidity sensor 323, the sheet detection sensor 205, the optical sensor 321 that counts a slit of the code wheel rotating in synchronization with the conveyance roller, and the encoder sensor 208 of the carriage are input to the control circuit 300. The control circuit 300 controls the conveyance motor 26 that drives the conveyance roller 21, a carriage motor 322, and the recording head 200.

Next, a control operation in the present exemplary embodiment will be described. In the present exemplary embodiment, a recording area is divided in the conveyance direction of the recording sheet according to a position of a leading edge of the recording sheet, and a threshold value of an allowable curl amount upon transfer to each of the recording areas is set. The recording area of the recording sheet P is an area on which recording is performed by the recording head 200 while the leading edge of the recording sheet is conveyed from a predetermined position to another predetermined position.

Figure 3A:
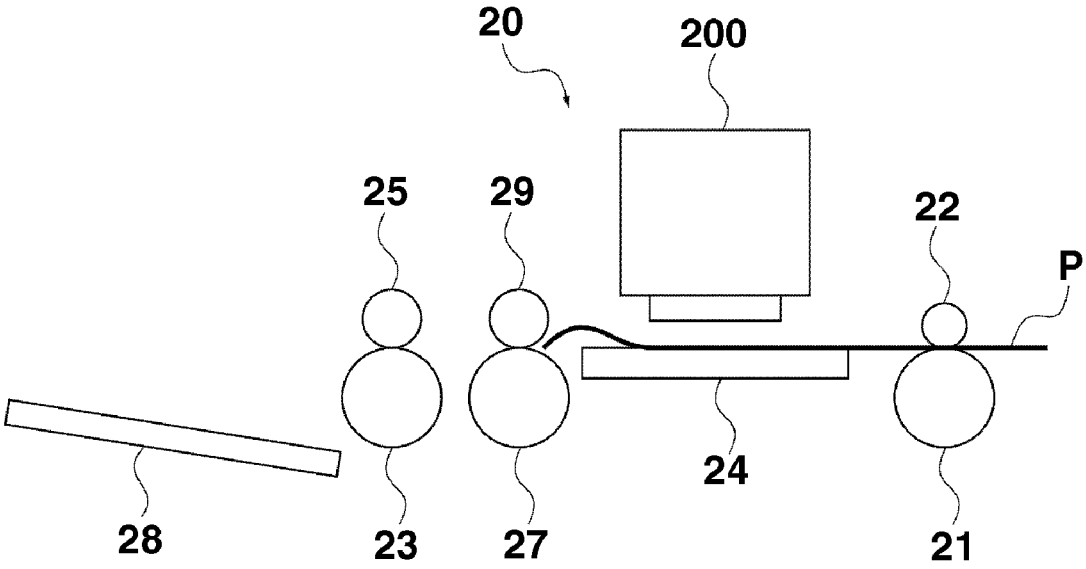
FIGS. 3A and 3B illustrate a position of a leading edge of a recording sheet and a recording area.
Figure 3B:
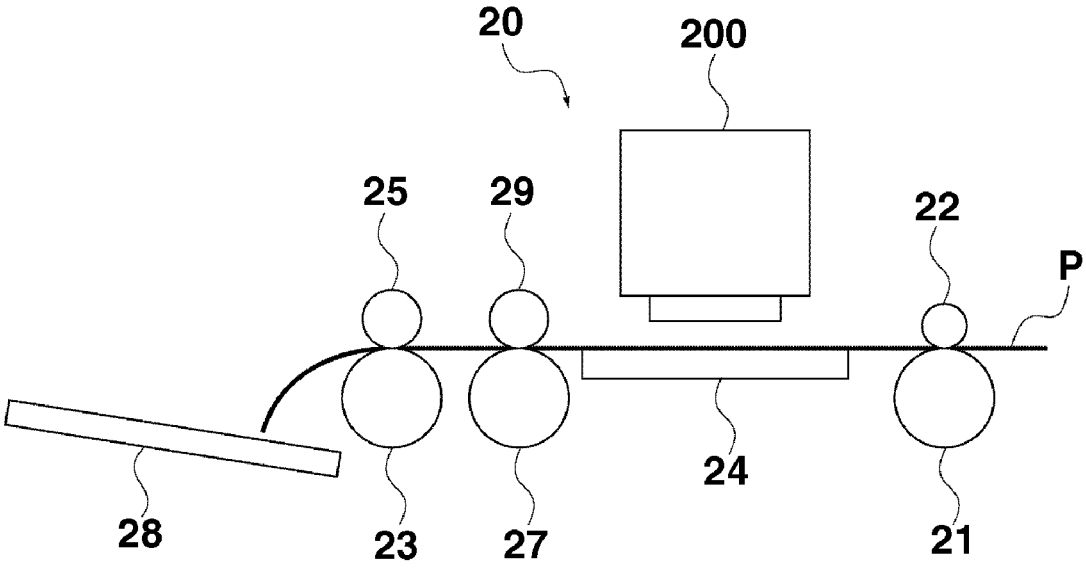

FIGS. 3A and 3B are schematic sectional views illustrating the position of the leading edge of the recording sheet P at a divided position of the recording area in the conveyance unit 20.

FIG. 3A illustrates the position where the leading edge of the recording sheet P enters a nip (predetermined position) between the auxiliary sheet discharge roller 27 and the spur 29. Before the leading edge of the recording sheet P enters the auxiliary sheet discharge roller 27, the recording head 200 performs a recording operation on the recoding sheet P only with a paper feeding operation by the conveyance roller 21. An area on the recording sheet P on which recording is performed by the recording head by the time when the leading edge of the recording sheet P enters the auxiliary sheet discharge roller 27 is defined as a recording area A1.

When the recording operation is performed only by the paper feeding operation by the conveyance roller 21, the leading edge of the recording sheet P is pressed against the platen 24 by stiffness of the sheet, but the sheet is in a free state. Therefore, when a large amount of ink is applied during the recording operation, the recording sheet P extends to produce a curl. When the produced curl greater than or equal to a certain amount is produced in the recording area A1, the leading edge of the recording sheet P cannot enter the nip between the roller pairs, when the recording sheet P enters the roller pairs such as the auxiliary sheet discharge roller 27 and the spur 29, so that a jam occurs. A curl amount threshold value that specifies a curl amount range by which the recording sheet P can enter the auxiliary sheet discharge roller 27 without any trouble is obtained beforehand by a test. When the ink amount used for the recording operation on the recording area A1 produces the curl exceeding the curl amount threshold value, the timing when the recording sheet P enters the auxiliary sheet discharge roller 27 has to be delayed to reduce the curl amount by evaporation of the ink.

FIG. 3B illustrates the position where the leading edge of the recording sheet P reaches the sheet discharge tray 28. When the leading edge of the recording sheet P reaches the sheet discharge tray 28, the recording operation by the recording head 200 is sometimes continued. An area subsequent to the recording area A1 and on which the recording is performed by the recording head 200 by the time when the leading edge of the recording sheet P reaches the sheet discharge tray 28 is defined as a recording area A2. The recording area A2 is specified by the divided position where the leading edge of the recording sheet P reaches the sheet discharge tray 28. However, there may be the case in which recording sheets, which have already been subject to the recording operation, are stacked on the sheet discharge tray 28 in a continuous printing for a plurality of sheets. Therefore, the position where the leading edge of the recording sheet P reaches the sheet discharge tray 28 may be changed considering a predetermined number of the stacked sheets.

When a curl in a certain amount is produced on the recording sheet P when the leading edge thereof reaches the sheet discharge tray 28, the leading edge of the recording sheet P is curled up to direct toward the upstream side on the sheet discharge tray 28. Therefore, the recording sheet P cannot be discharged flatly onto the sheet discharge tray 28. Accordingly, a threshold value of the curl amount to a degree in which the leading edge is not curled up onto the sheet discharge tray 28 when the recording sheet P is discharged onto the sheet discharge tray 28 is obtained beforehand from an experiment. When the curl amount exceeds the threshold value, processing for increasing the recording time has to be performed to delay the timing when the leading edge of the recording sheet reaches the sheet discharge tray 28.

Figure 4:
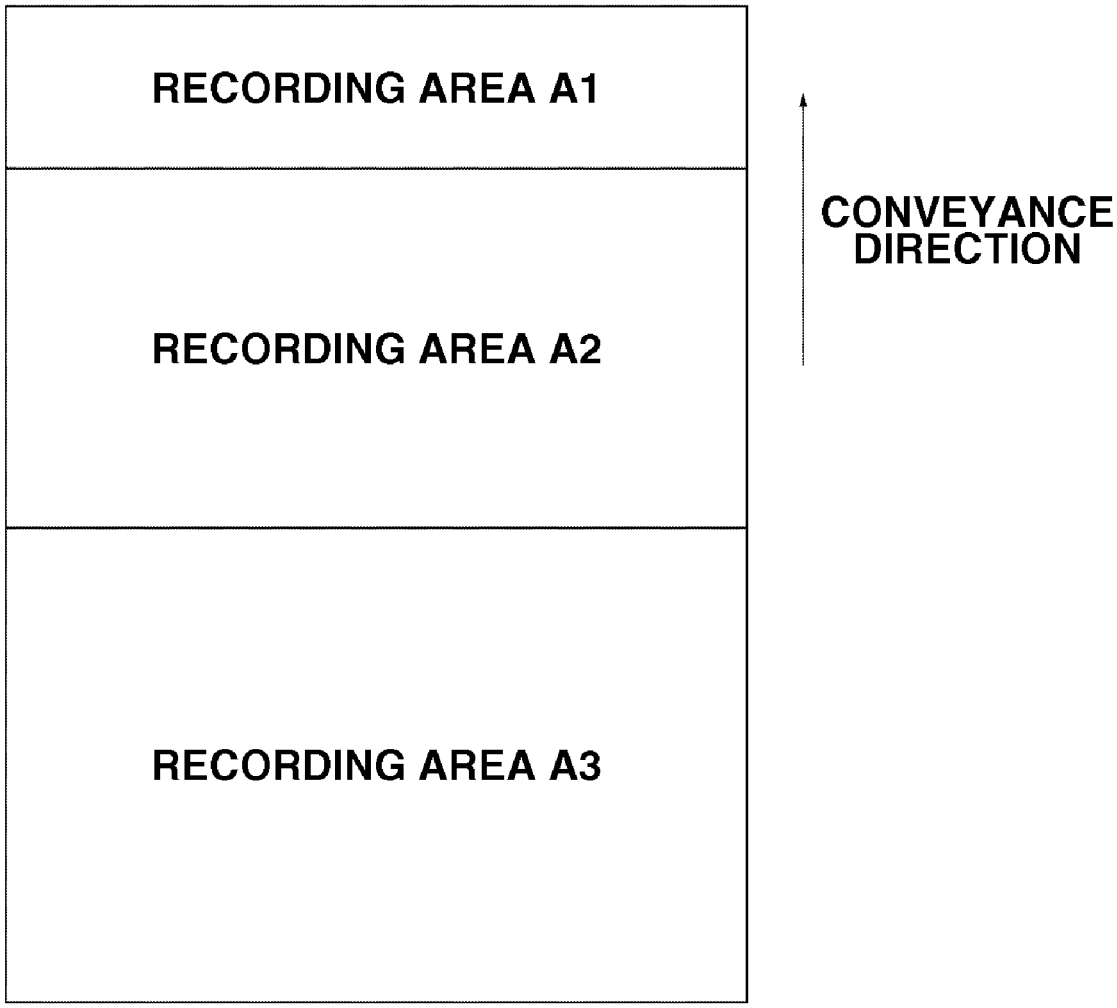
FIG. 4 is an explanatory view of the recording area.

Regarding division of the recording area, FIG. 4 is a schematic view illustrating division of the areas of the recording sheet P using the recording position by the recording head 200 as a reference. In the inkjet recording apparatus according to the present exemplary embodiment, a current recording position by the recording head 200 is defined as a reference to detect a current leading edge position of the recording sheet P according to which area of the recording sheet P is recorded by the recording head 200.

Figure 5:
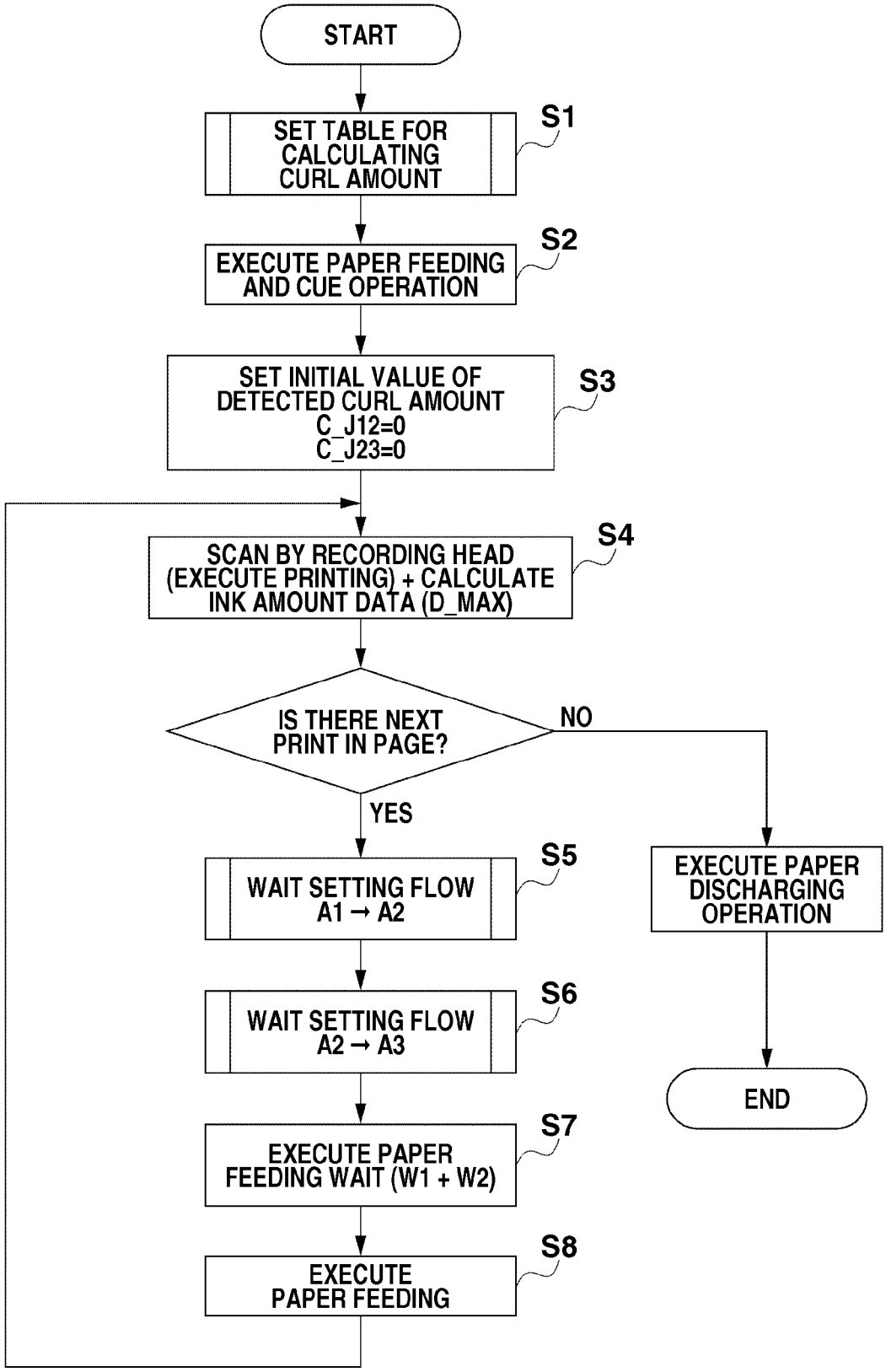
FIG. 5 is a flowchart illustrating an operation.

FIG. 5 is a flowchart illustrating a control operation according to the present exemplary embodiment. The control is executed by the control circuit 300 including the CPU 310, the ROM 311 that stores the data and control program, and the RAM 312. The control circuit 300 serves as an ink amount acquiring unit, a recording time acquiring unit, and a curl amount acquiring unit, as described below.

The control is executed when an instruction to turn ON a paper jam avoiding curl control mode and an instruction value indicating that a type of the recording sheet is plain paper according to the present exemplary embodiment are transmitted from a printer driver (not illustrated).

Figure 6:
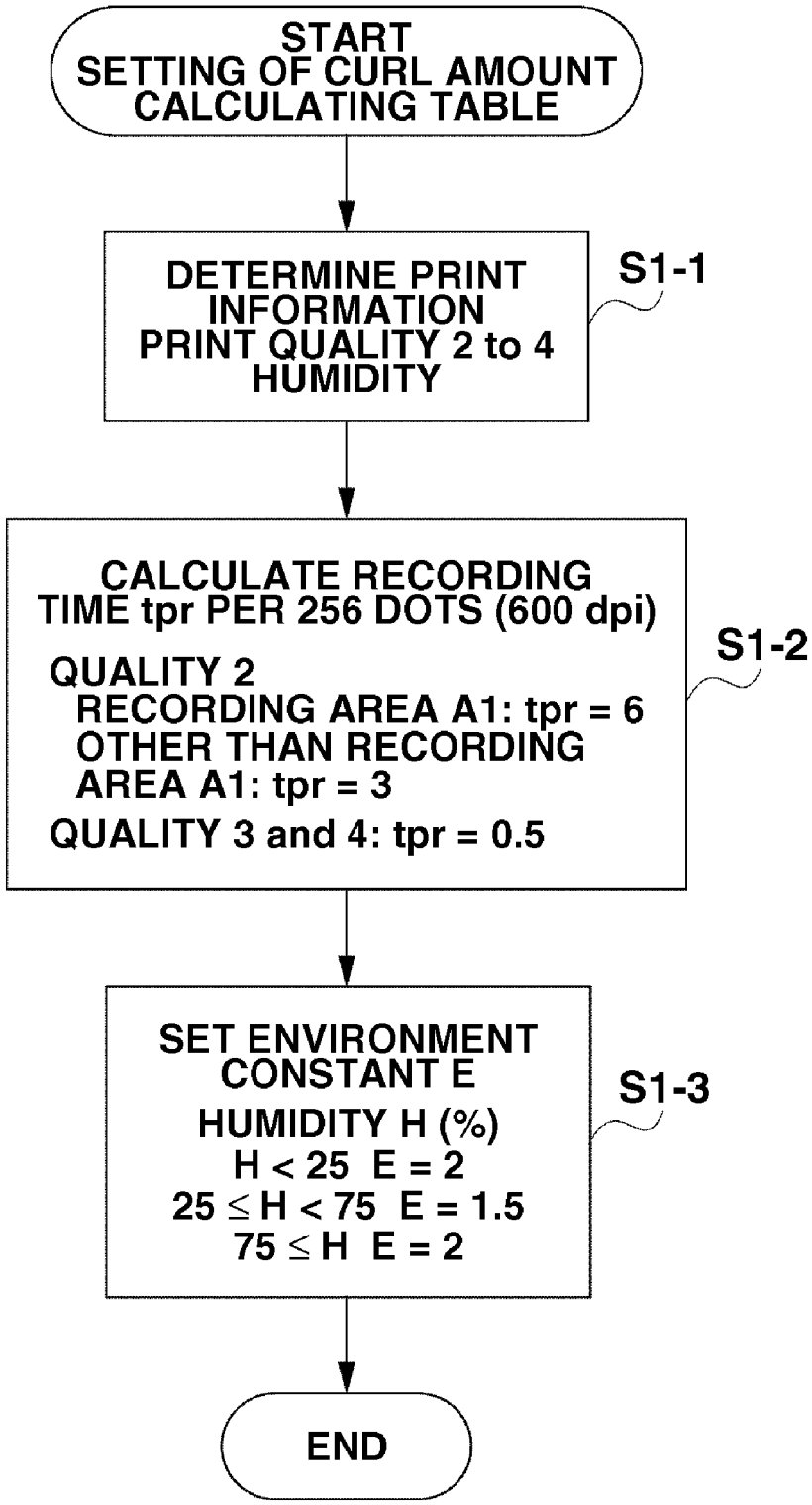
FIG. 6 is a flowchart of a curl amount calculating table setting.

Firstly, in step S1, a table for calculating a curl amount is set. FIG. 6 illustrates a detailed flow of setting the curl amount calculating table. In step S1-1, a recording quality is read from print information transmitted from the printer driver, and humidity information is read from the humidity sensor 323 (FIG. 2) mounted on the main body of the printer.

Acquisition of the recording time will next be described. The recording time acquiring unit acquires recording time per unit recording area. The recording head 200 according to the present exemplary embodiment has a width corresponding to 512 nozzles in 1200 dots per inch (dpi). In step S1-2, recording time tpr is set based on the recording quality as the recording area corresponding to the nozzle width being defined as the unit recording area. In step S1-2, the recording time per unit recording area of 256 dots is acquired.

Then in step S1-3, an environment constant E is set based on the humidity information from the humidity sensor. When the detected humidity H is smaller than 25%, the environment constant E is set to 2, when the detected humidity H is 25% or more and less than 75%, the environment constant E is set to 1.5, and when the detected humidity H is 75% or more, the environment constant E is set to 1. Each of the values is a coefficient indicating a curl growth rate depending upon the humidity. These values are derived from the experiment using the recording sheet that is to be the subject. These values are stored in the RAM 312 or the ROM 311. Environmental information may be set such that the humidity is considered based on the type of the sensor incorporated in the printer, or may be set considering only disadvantageous condition without providing the sensor.

When the curl amount calculating table is determined, the recording operation is started.

Returning to FIG. 5, in step S2, a feeding operation from the paper feed unit 201 is started to execute a cue operation in which the recording sheet P is conveyed to a recording start position.

Firstly, in step S3, initial values of a detection curl amount parameter C_J12 that is a transfer condition from the recording area A1 to the recording area A2, and a detection curl amount parameter C_J23 that is a transfer condition from the recording area A2 to the recording area A3 are set.

In step S4, a recording operation for one scan is executed by the recording head 200. In step S4, an ink amount is also acquired. More specifically, a printing ratio is calculated as the ink amount.

Figure 7:
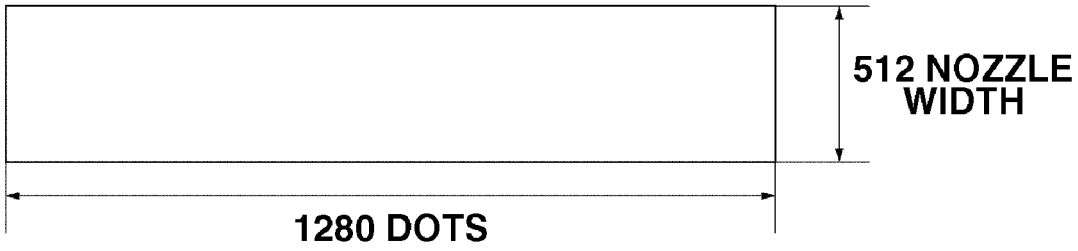
FIG. 7 illustrates a check box for detecting a printing ratio.

FIG. 7 illustrates a check box for detecting the printing ratio. The check box is an area having a width corresponding to 512 dots in the sub-scanning direction and a length corresponding to 1280 dots in the scanning direction of the recording head. The length in the sub-scanning direction (512 dots) is the same as the number of the nozzles of the recording head 200. Accordingly, the total dot number in the check box is 512*1280=655360 dots.

The printing ratio in the case in which 327680 dots are printed within the range of the check box with a color nozzle having an ejection amount of 2 pl is defined as 100%. The printing ratio is calculated as the value compared to the above printing ratio. The printing ratio obtained by using a nozzle having an ejection amount of 1 pl is calculated with the ink amount of 1/4 to the nozzle of 2 pl defined as 100%. The printing ration might exceed 100% depending on image data. However, since the printing ratio is an operation value for the control, there is no trouble for the control. The printing ratios calculated on the respective areas which are divided per 1280 dots in the main scanning direction, are compared in the entire area in the main scanning direction, and the greatest printing ratio is defined as a representative value which is specified as a printing ratio D_MAX. The printing ratio D_MAX is used as the ink amount for calculating the curl amount, as described below.

Figure 8:
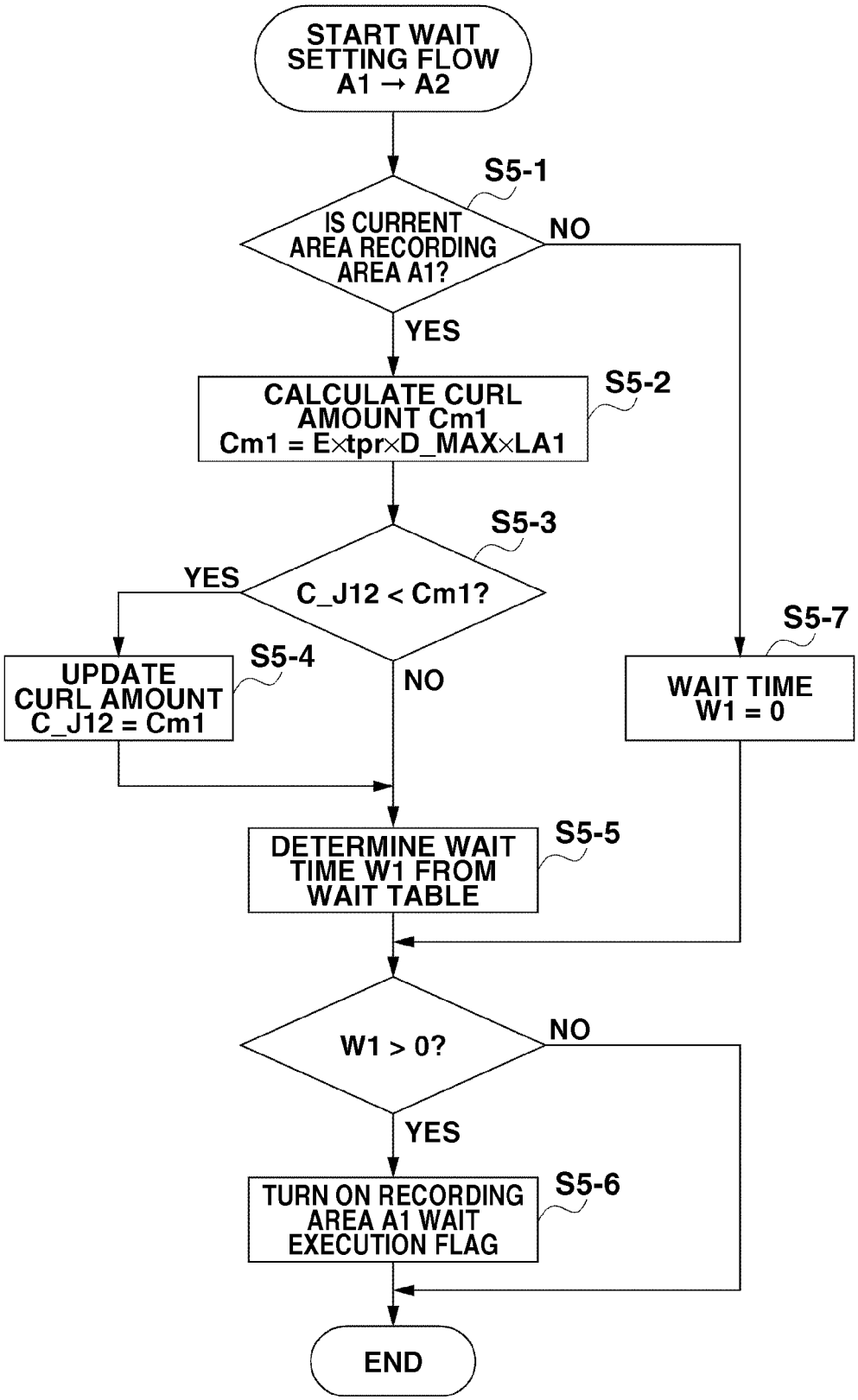
FIG. 8 is await setting flowchart upon transfer from a recording area A1 to a recording area A2.

Next, in step S5, a wait setting is performed for the calculation of the curl amount and control of the curl amount when the area is transferred from the recording area A1 to the recording area A2. In step S5, wait time when the current recording area is transferred to the recording area A2 during performing the recording operation on the recording area A1 is determined as illustrated in FIG. 8. When the recording operation is not performed on the recording area A1, the wait time W is set to zero.

In the wait setting, delay time (wait time) is specifically determined by determining to what degree the timing of transferring the current recording area to the next recording area is delayed.

Next, in step S6, a wait setting is performed for the calculation of the curl amount and control of the curl amount when the area is transferred from the recording area A2 to the recording area A3. In step S6, wait time when the current recording area is transferred to the recording area A3 during performing the recording operation on the recording area A2 is determined. When the recording operation is not performed on the recording area A2, the wait time W is set to zero. The detail of the wait setting will be described below.

In step S7, the respective wait times W1 and W2 which are determined according to the wait setting flows are counted. More specifically, when the area is transferred from the recording area A1 to the recording area A2, the wait time W1 is substantially counted, since the wait time W2=0. On the other hand, when the area is transferred from the recording area A2 to the recording area A3, the wait time W2 is counted, since the wait time W1=0. Execution of the wait is not necessarily done at this timing. There are various manners as described below for the execution of the wait.

One example of the execution of the wait for the curl amount control is to increase time taken from completion of one scan by the recording head to a start of the next feeding operation. Alternatively, time taken from completion of the paper feeding operation per one scan to a start of the next scanning operation may be increased. In the present exemplary embodiment, the wait is provided before the paper feeding operation. However, the wait may be provided after the next scan by the recording head 200. The timing may be delayed by decreasing a paper feeding speed or a scanning speed of the recording head 200 to increase the scanning time. The timing may be delayed by increasing a scanning distance of the recording head 200 to increase the scanning time. Further, the number of times of the scan by the recording head for performing the recording operation on the recording area A may be increased. One of these manners may be performed, or two or more manners may be combined.

In step S8, the paper feeding operation corresponding to the recording operation of one scan by the recording head 200 is executed by the conveyance roller 21 or the like. After the execution of the paper feeding operation, the processing returns to step S4, thus, the recording operation for one scan of the recording head 200 can be executed. The processing is repeated until there is no recording data.

When there is no recording data, the recording operation is completed. Then, the paper discharging operation is executed. Thus, the control operation is completed.

Figure 9:
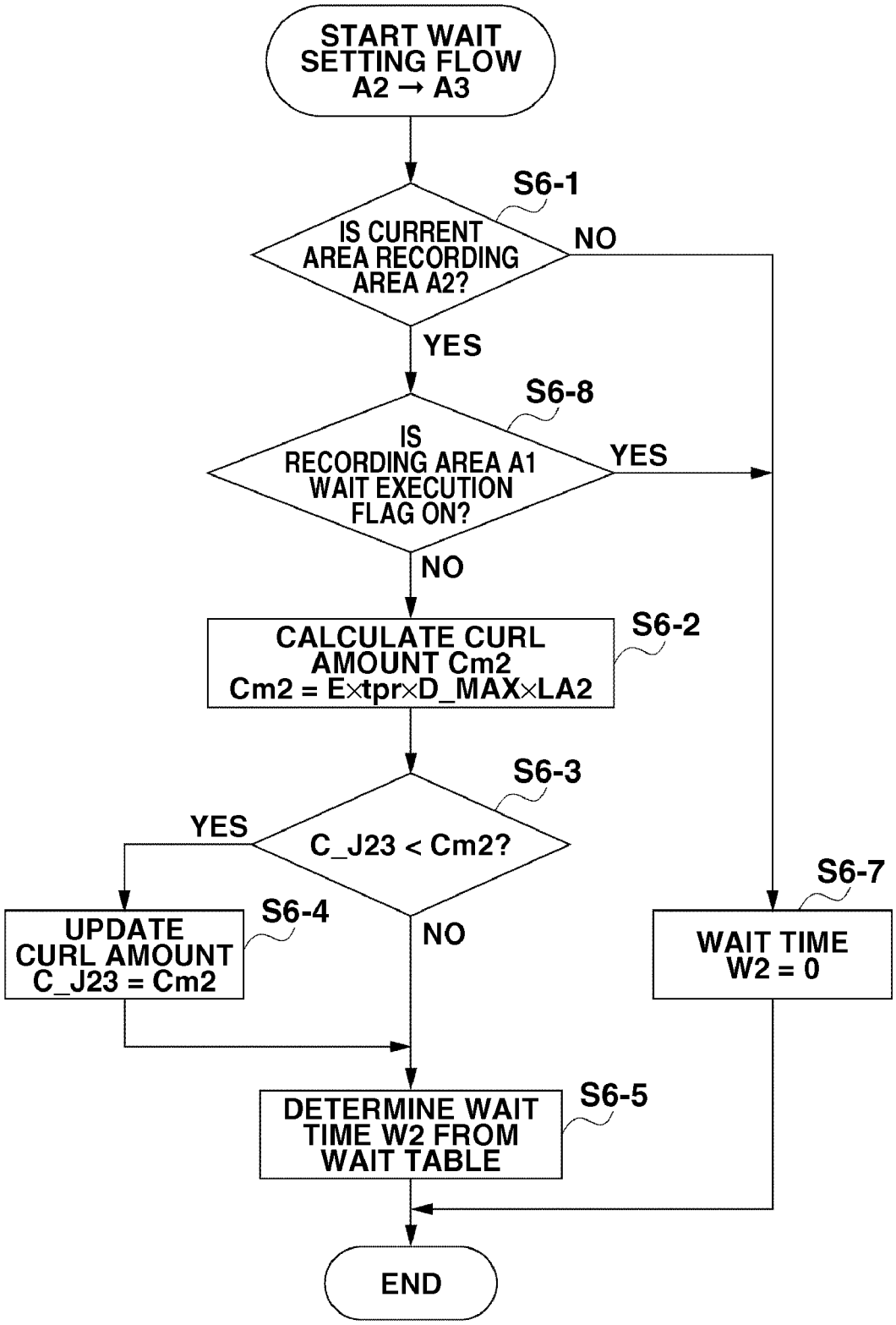
FIG. 9 is await setting flowchart upon transfer from a recording area A2 to a recording area A3.

FIGS. 8 and 9 are flowcharts illustrating the detail of the wait setting for the calculation of the curl amount and the control of the curl amount when the area is transferred from the recording area A1 to the recording area A2 and from the recording area A2 to the recording area A3, respectively. Tables 1 and 2 are wait tables used for determining the wait times in the recording areas A1 and A2 based on the detected curl amount, respectively.

A method for determining the wait time for the recording area A1 will be described below with reference to FIG. 8 and Table 1.

Firstly, in step S5-1, it is checked whether the current recording area is the recording area A1. If the current recording area is not the recording area A1 (NO in step S5-1), then in step S5-7, the wait time is set to zero (W1=0) and the processing is ended. When the recording area is the recording area A1 (YES in step S5-1), the processing proceeds to step S5-2. In step S5-2, a curl amount Cm1 which is grown by the time when the area is transferred to the recording area A2 is estimated from the recording time tpr and the environment constant E set in step S1, the printing ratio D_MAX detected in step S4, and a total conveyance distance LA1 of the recording area A1. The calculation equation is as follows:

$$Cm1=E*tpr*D_MAX*LA1 \qquad \text{Equation 1}$$

In the equation, the curl amount Cm1 is a relative value that is calculated to facilitate the operation from the viewpoint of the control, and it is not an absolute value of the curl amount.

As described above, the curl amount is calculated based on the information involved with recording conditions including the recording quality, the recording time per the unit recording area, the ink amount, and the environmental information such as humidity and temperature.

In step S5-3, an estimated curl amount C_J12 in the recording area A1 at the present is compared to the curl amount Cm1 calculated in step S5-2. When the curl amount Cm1 is greater than C_J12 (YES in step S5-3), the processing proceeds to step S5-4. In step S5-4, the curl amount is updated in such a manner that the curl amount Cm1 is defined as the curl amount C_J12 of the recording area A1. If the current operation is the recording operation of the first scanning operation, the curl amount C_J12 at the present is zero (C_J12=0), but if not, the maximum value of the curl amount Cm1 calculated in the previous operation is to be input to the curl amount C_J12. As described above, the control circuit serves as the curl amount acquiring unit for acquiring the curl amount.

In step S5-5, an actual wait time W1 in the recording area A1 is determined based on Table 1, that is the wait table, from the detected curl amount C_J12. If the curl amount C_J12 is less than 400, the wait time W1 is zero (W1=0), so that the wait is unnecessary. In this case, it is assumed that the threshold value of the C_J12 is 400, and the control unit acquires, as a threshold value acquiring unit, the threshold value of the curl amount from the wait table. When the curl amount C_J12 is 400 or more, which means that the curl amount exceeds the threshold value, the wait time is used to control the curl amount. When the curl amount C_J12 is 400 or more and less than 1000 (first value), the wait time W1 is set to 1 second, and when the curl amount C_J12 is 1000 or more (second value), the wait time W1 is set to 3 seconds.

As described above, the recording operation is controlled to change the time from the point when the recording head 200 starts the scan for performing the recording operation on the recording area A to the point when the leading edge of the recording sheet reaches the auxiliary sheet discharge roller 27, that is the predetermined position, according to the curl amount acquired by the curl amount acquiring unit.

For example, the time taken from the point when the recording head 200 starts the scan for the recording operation on the recording area A1 to the point when the leading edge of the sheet reaches the auxiliary sheet discharge roller 27, which is the predetermined position, when the curl amount is the first curl amount is defined as first time. Further, the time taken from the point when the recording head 200 starts the scan for the recording operation on the recording area A1 to the point when the leading edge of the sheet reaches the auxiliary sheet discharge roller 27, which is the predetermined position, when the curl amount is the second curl amount which is smaller than the first curl amount is defined as second time. The wait time is determined such that the first time is longer than the second time.

The wait time may be necessary and sufficient time to decrease the current curl amount to be smaller than the threshold value, or the wait time may be shorter than the sufficient time.

TABLE 1

| C_J12 | C_J12 < 400 | 400 ≦ C_J12 < 1000 | 1000 ≦ C_J12 |
|---|---|---|---|
| W1 | 0 second | 1 second | 3 seconds |

When the wait is executed for the recording area A1 (W1>0), in step S5-6, a wait execution flag for the recording area A1 is turned ON. The flag is used for determining whether the wait is executed for the below described recording area A2.

Next, a method for determining the wait time for the recording area A2 will be described with reference to FIG. 9 and Table 2.

Firstly, in step S6-1, it is checked whether the current recording area is the recording area A2. If the current recording area is not the recording area A2 (NO in step S6-1), the processing proceeds to step S6-7. In step S6-7, the wait time is set to zero (W2=0) and then the processing is ended. When the current recording area is the recording area A2 (YES in step S6-1), then in step S6-8, the wait execution flag for the recording area A1 is checked. If wait execution flag is ON (YES in step S6-8), it is determined that a sufficient wait has already been executed. Therefore, if the wait is not executed for the recording area A2, the jam does not occur due to the curl on the leading edge of the recording sheet P when the area is transferred from the recording area A2 to the recording area A3. Accordingly, in step S6-7, the wait time W2 is set to zero (W2=0), and then, the processing is ended.

When the recording area is the recording area A2, and the wait is not executed for the recording area A1 (NO in step S6-8), the processing proceeds to step S6-2. In step S6-2, the curl amount is calculated from the recording time tpr and the environment constant E set in step S1, and the printing ratio D_MAX detected in step S4. Further, a curl amount Cm2 which is grown by the time when the area is transferred to the recording area A3 is estimated from a total conveyance distance LA2 of the recording area A1 and the recording area A2. The calculation equation is as follows:

$$Cm2=E*tpr*D_MAX*LA2 \qquad \text{Equation 2}$$

In the equation, the curl amount Cm2 is a relative value that is calculated to facilitate the operation from the viewpoint of the control, and it is not an absolute value of the curl amount.

In step S6-3, an estimated curl amount C_J23 in the recording area A2 at the present is compared to the curl amount Cm2 calculated in step S6-2. When the curl amount Cm2 is greater than C_J23 (YES in step S6-3), the processing proceeds to step S6-4. In step S6-4, the curl amount is updated in such a manner that the curl amount Cm2 is defined as the curl amount C_J23 of the recording area A2.

In step S6-5, an actual wait time W2 in the recording area A2 is determined based on Table 2, that is the wait table, from the detected curl amount C_J23. When the curl amount C_J23 is less than 800, the wait time W2 is zero (W2=0), so that the wait is unnecessary. On the other hand, when the curl amount C_J23 is 800 or more, the wait time is used to control the curl amount. When the curl amount C_J23 is 800 or more and less than 1000, the wait time W2 is set to 1 second, and when the curl amount C_J23 is 1000 or more, the wait time W2 is set to 3.5 seconds.

TABLE 2

| C_J23 | C_J23 < 800 | 800 ≦ C_J23 < 1000 | 1000 ≦ C_J23 |
|---|---|---|---|
| W2 | 0 second | 1 second | 3.5 seconds |

According to the above described curl amount control, occurrence of the paper jam can be prevented when the area is transferred from the recording area A1 to the recording area A2 or from the recording area A2 to the recording area A3. The case in which the curl control by the wait operation is used for the recording area A1 and the case in which the curl control by the wait operation is used for the recording area A2 are determined from the recording time and the printing ratio, so that only the wait time can be set.

As described above, according to the present exemplary embodiment, an inkjet recording apparatus that has a simple configuration, can prevent a misalignment of discharged recording sheets and paper jam which are caused by a curl of the recording sheet, and can minimize reduction in recording time without providing unnecessary drying time.

In the first exemplary embodiment, the wait time W2 for the recording area A2 is determined based on the printing ratios of both the recording area A1 and the recording area A2.

However, in a second exemplary embodiment, the wait time W2 for the recording area A2 may be determined from only the printing ratio of the recording area A1, when a height difference between the sheet discharge roller 23 and the sheet discharge tray 28 is small.

In this case, the equation for calculating the wait time for the recording area A2 may be provided based on the following equation.

$$Cm2=C_J12*LA2/LA1 \qquad \text{Equation 3}$$

This equation may be obtained by changing the equation in step S6-2 in the flowchart in FIG. 9. The curl amount C_J12 for the recording area A1 is recorded when the area is transferred from the recording area A1 to the recording area A2. Therefore, when the curl amount Cm2 is calculated based on the C_J12 after the transfer to the recording area A2, the wait time W2 considering the recording time for the recording area A2 can be calculated.

When the area in which the printing ratio D_MAX is detected does not agree with the recording area, and a different area is used according to a conveyance path, the recording time can further be reduced.

In the first and second exemplary embodiments, the recording time tpr is uniquely set based on the recording quality. In a third exemplary embodiment, the recording time tpr is updated and used for every routine by counting the elapsed time from the start of the recording operation.

Figure 10:
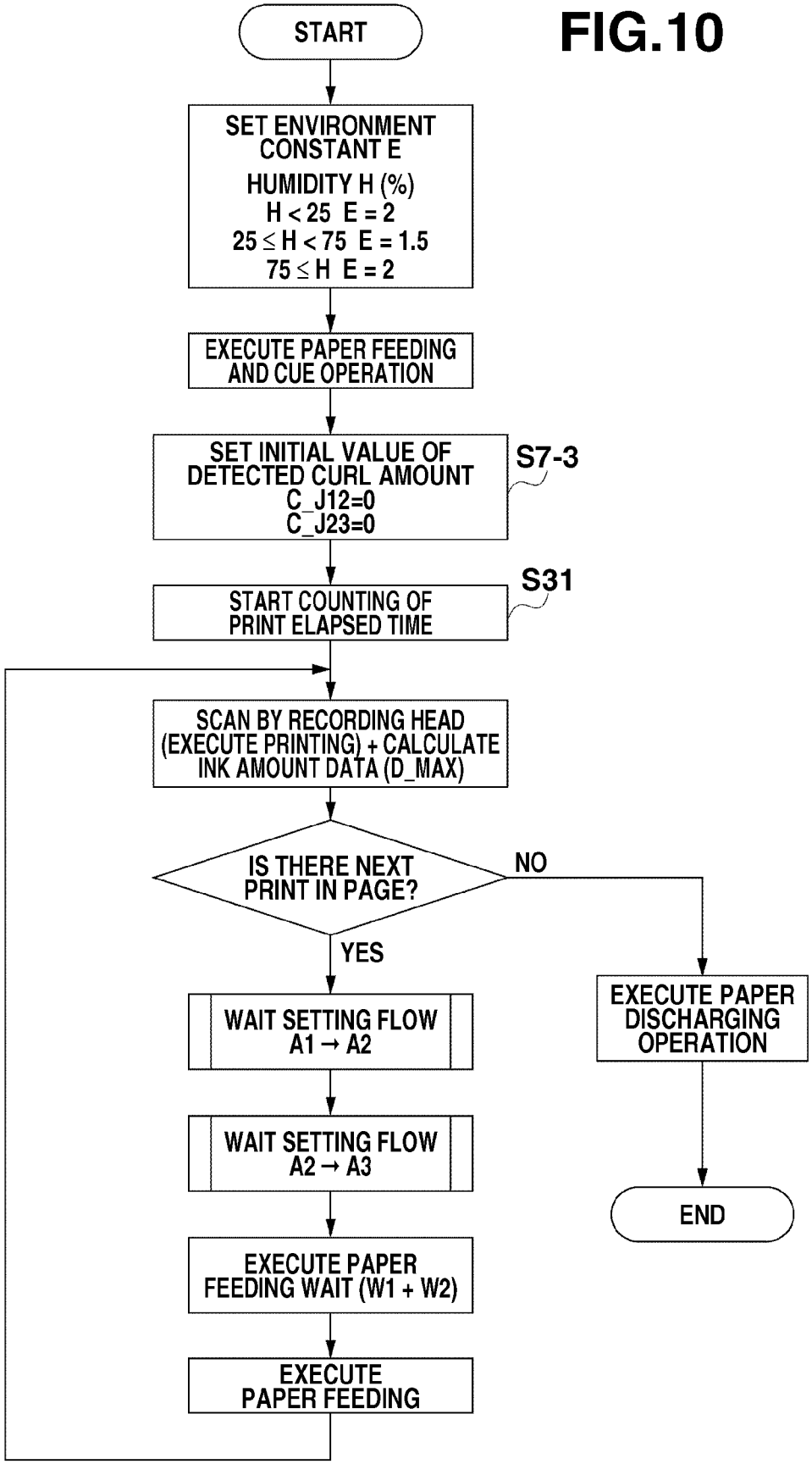
FIG. 10 is a flowchart illustrating an operation in a third exemplary embodiment of the present invention.

FIG. 10 is a flowchart illustrating the control operation of the present exemplary embodiment.

The difference from the flowchart in the first exemplary embodiment (FIG. 6) is that counting of elapsed-recording time is started in step S31 after an initial value of a detection curl amount parameter is set in step S7-3, and then, the recording operation by the recording head 200 is started. With this processing, the curl amount can more accurately be detected.

In the above described exemplary embodiments, the estimated curl amount is determined such that the curl amount Cm1 or Cm2 is updated with the update of the printing ratio D_MAX. In this case, the maximum curl amount is estimated in a unit of the nozzle width of the recording head 200, not with the ratio of the ink amount to the entire recording area A1 or the entire recording area A2. Therefore, an error might occur depending upon image data.

In a fourth exemplary embodiment, the curl amount is accumulated to reduce an error depending upon the image data, so that the curl amount is calculated with higher precision.

Figure 11:
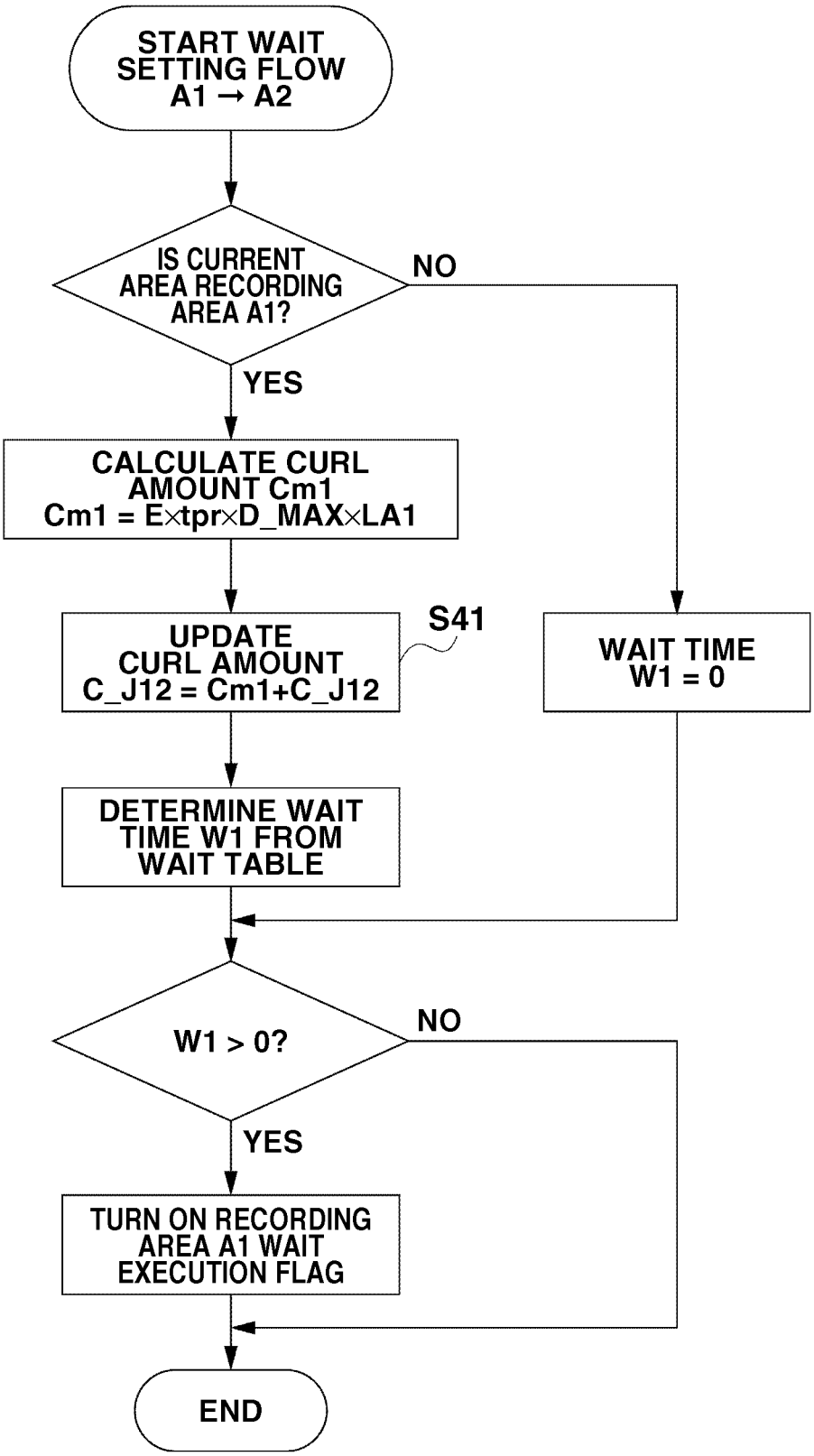
FIG. 11 is a flowchart illustrating an operation in a fourth exemplary embodiment of the present invention.

FIG. 11 is a wait setting flow in the present exemplary embodiment. In step S41, the curl amount C_J12 is accumulated and obtained based on the curl amount Cm1, to detect the curl amount with high precision.

In the above described exemplary embodiments, the ink amount acquiring unit acquires the ink amount as the printing ratio D_MAX.

In a fifth exemplary embodiment, the ink amount may be acquired as an ink amount per unit area. More specifically, when the ink amount in the recording area A1 is obtained, the dot number of an image recorded on the recording area A1, an area of the recording area A1, and an ejection amount of the nozzle per one dot are acquired from recording information.

(dot number)*(nozzle ejection amount)/(area) Equation 4

According to the equation 4, an average ink amount per unit area can be obtained.

As another exemplary embodiment of the ink amount acquiring unit, an image to be recorded may be divided into an object unit, an average printing duty in the object may be obtained, and the maximum value of the average printing duty of the respective objects existing in a predetermined area may be acquired as the printing ratio D_MAX.

Alternatively, a recording area may be divided into a unit area, and the printing ratio in a portion which includes most a specific code with the high printing ratio among printing codes such as a character code included in the recording information may be calculated and acquired as the printing ratio D_MAX.

Further, the ink amount per unit area may be acquired according to the dot number recorded per unit time.

In the above described exemplary embodiments, the recording time acquiring unit acquires the recording time per the unit recording area. In the present exemplary embodiment, the recording time acquiring unit may calculate the recording time using the conveyance amount and conveyance speed for one conveyance operation, the scanning speed and scanning distance of the carriage, and the number of times of the scan by the carriage per unit recording area. These factors may be all combined. Alternatively, only one factor may be used, or two or more factors may be combined to calculate the recording time.

More specifically, the recording time can be calculated by the following equation 5.

{(conveyance amount)/(conveyance speed)+(scanning distance)/(scanning speed)}*(number of scanning times)

However, to simplify the calculation processing, one or two of (conveyance amount)/(conveyance speed), (scanning distance)/(scanning speed), and (number of scanning times) may be omitted from the equation 5.

As described above, according to the present exemplary embodiment, an inkjet recording apparatus that has a simple configuration, can prevent a misalignment of discharged recording sheets and paper jam which are caused by a curl of the recording sheet, and can minimize reduction in recording time without providing unnecessary drying time.

In each of the above described exemplary embodiments, the relative curl amount is acquired to determine the wait time. The curl amount is a function of the humidity, the recording time tpr, the ink amount and the total conveyance distance. Therefore, the control can be more simplified if a table from which the wait time can directly be acquired from these values is prepared. As a sixth exemplary embodiment, the configuration in which the wait time is directly acquired from the ink amount, which most affects the curl amount, will be described below.

Figure 12:
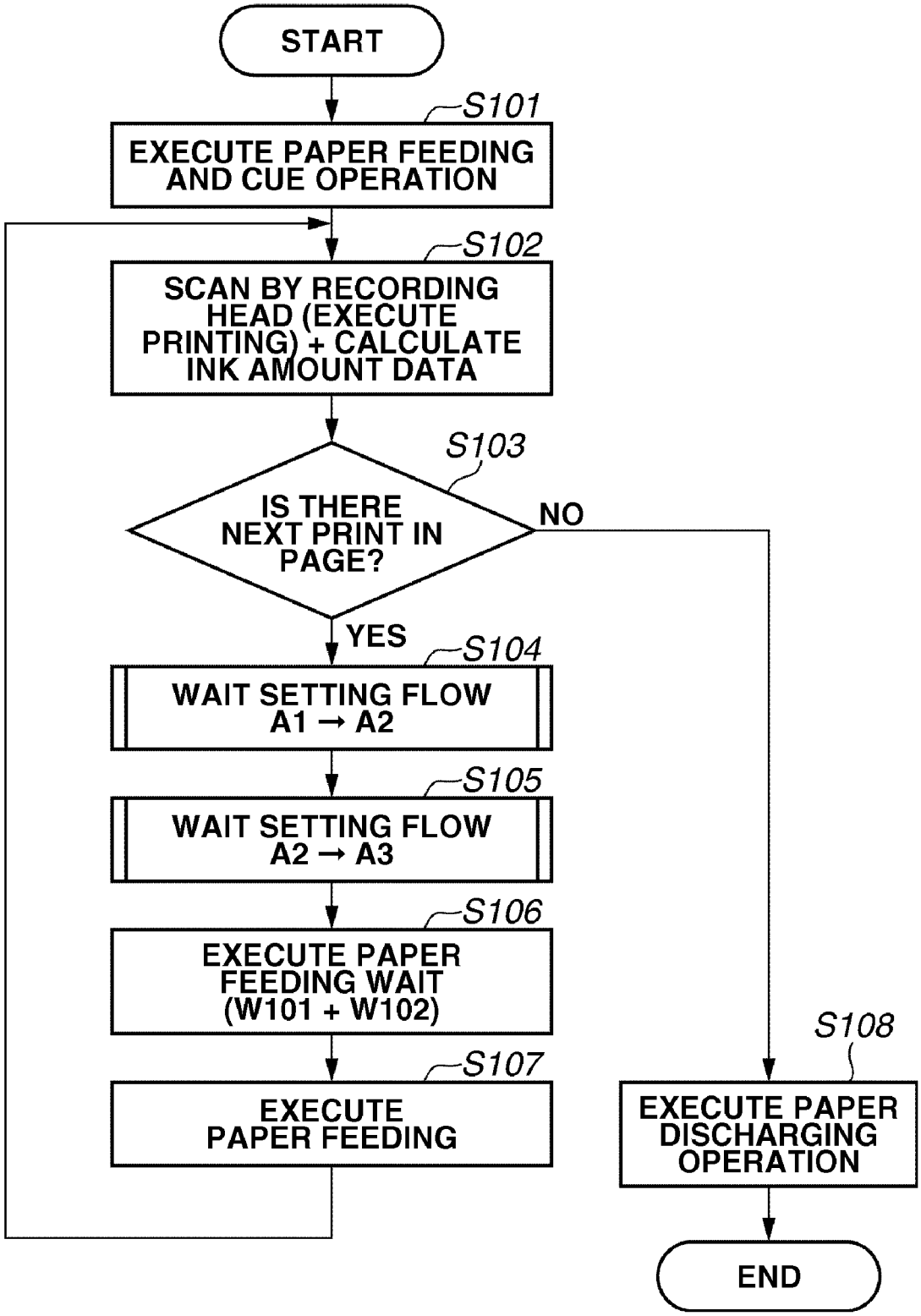
FIG. 12 is a control flowchart of a sixth exemplary embodiment of the present invention.

FIG. 12 is a control flowchart according to the sixth exemplary embodiment. In step S101, the paper feeding operation from the paper feed unit 201 is performed, and a cue operation of the recording sheet is executed by the conveyance roller 21. In step S102, the recording operation for one scan is performed by the recording head 200. Further, in step S102, the ink amount is acquired. The total amount of ink ejected by one scan or duty is used as the ink amount. In step S103, when it is determined that the last scan is completed (NO in step S103), the processing proceeds to step S108. In step S108, the recording sheet is discharged and the recording operation is ended.

When the recording operation is now being executed (YES in step S103), the program proceeds to step S104. In step S104, wait time W101 is determined by the time when the area is transferred from the recording area A1 to the recording area A2 while the recording operation is being performed on the recording area A1. When the recording operation is not performed on the recording area A1, the wait time W101 is set to zero (W101=0). In step S105, wait time W102 is determined for the transfer from the recording area A2 to the recording area A3 while the recording operation is being performed on the recording area A2. When the recording operation is not performed on the recording area A2, the wait time W102 is set to zero (W102=0).

In step S106, the wait in which the transfer to the next area is delayed by the wait time W101 and W102 is executed. Similar to the first exemplary embodiment, the wait operation is not always executed at this timing.

In step S107, the recording sheet is conveyed by a predetermined distance for the next scan, and then, the processing returns to step S102.

Figure 13:
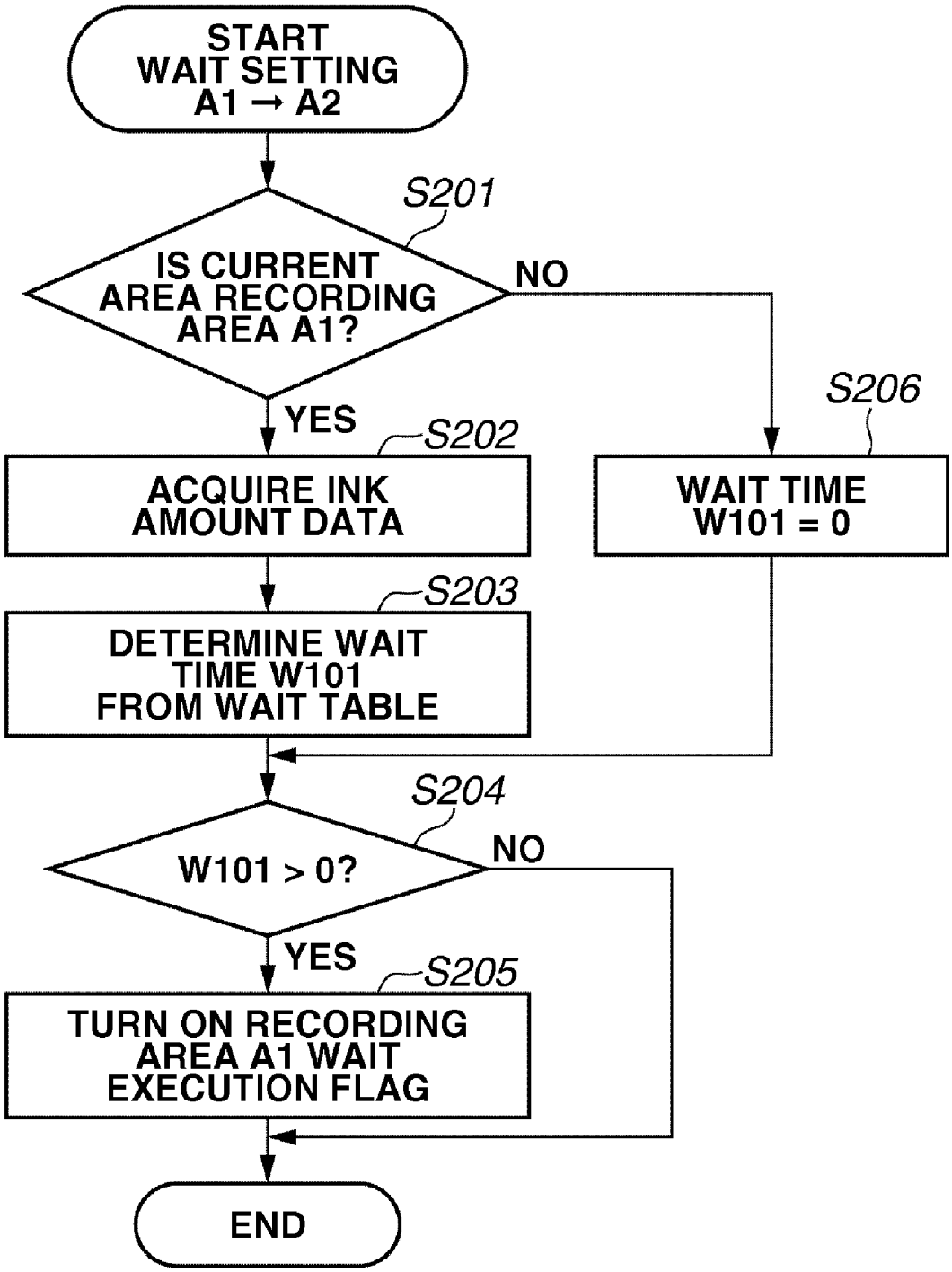
FIG. 13 is a flowchart to determine wait time upon the transfer from the recording area A1 to the recording area A2.
Figure 14:
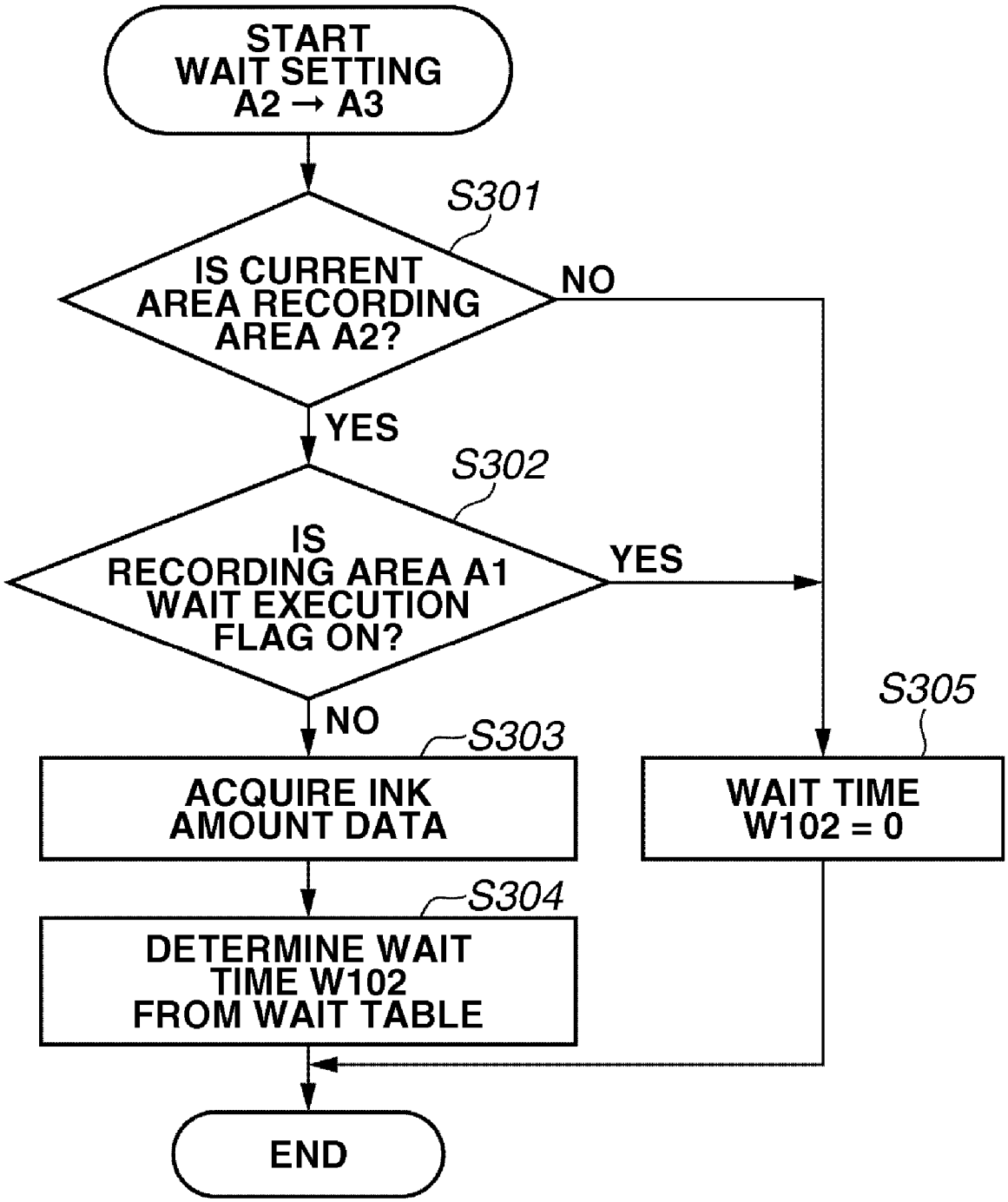
FIG. 14 is a flowchart to determine wait time upon the transfer from the recording area A2 to the recording area A3.

FIGS. 13 and 14 are flowcharts for determining the wait time during when the area is transferred from the recording area A1 to the recording area A2 and the wait time during when the area is transferred from the recording area A2 to the recording area A3, respectively.

When the recording operation is being performed on the recording area A1 in step S201 in FIG. 13 (YES in step S201), then in step S202, the ink amount ejected in the scan immediately before this scan or the duty is acquired, and the wait time W101 is acquired from the wait table. Table 3 is one example of the wait table for acquiring the wait time from the duty. When the wait time is not zero, the wait execution flag for the recording area A1 is turned ON.

In FIG. 14, when the recording operation is being performed on the recording area A2 (YES in step 1), then in step S302, the wait execution flag for the recording area A1 is checked. If the wait execution flag is ON (YES in step S302), which means that the wait has already been executed for the recording area A1, the wait time W102 for the recording area A2 is set to zero (W102=0).

On the other hand, when the wait execution flag for the recording area A1 is OFF (NO in step S302), then in step S303, the ink amount is acquired. Then in step S304, the wait time is determined from the wait table of Table 3 stored in the ROM.

As apparent from Table 3, when the ink ejection amount in the recording area A1 is a first amount, for example, the time from the start of the scan by the recording head to the completion of the recording operation for the recording area A1 is increased more than the case in which the ink ejection amount is a second amount that is smaller than the first amount. The wait time may be increased stepwisely as illustrated in Table 3, or the wait time may be increased in proportion to the duty.

TABLE 3

| Duty [%] | Duty ≦ 20 | 20 < Duty ≦ 50 | 50 < Duty |
|---|---|---|---|
| W101 [100 ms] | 0 | 10 | 30 |
| W102 [100 ms] | 0 | 10 | 35 |

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-136367 filed Jun. 5, 2009, which is hereby incorporated by reference herein in its entirety.

What is claimed is:

1. An apparatus comprising:

a conveyance unit configured to convey a sheet;

a carriage configured to support and cause a recording head to scan for performing a recording operation on the conveyed sheet;

a curl amount acquiring unit configured to acquire a curl amount which is generated on the sheet when a leading edge of the sheet reaches a predetermined position, based on information regarding a condition of a predetermined recording area of the sheet on which the operation is performed;

a threshold value acquiring unit configured to acquire a threshold value of an allowable curl amount when the sheet passes through the predetermined position; and a control unit configured to control the recording operation in such that, when the acquired curl amount exceeds the threshold value, time taken from a start of the recording operation on the predetermined recording area to a point when the leading edge of the sheet reaches the predetermined position is increased more than a case when the curl amount does not exceed the threshold value.

2. The apparatus according to claim 1, wherein the start is a point when the recording head starts the scan for the recording operation on the predetermined recording area.

3. The apparatus according to claim 1, further comprising:

an ink amount acquiring unit configured to acquire an ink amount used for the recording operation on the predetermined recording area; and a time acquiring unit configured to acquire a recording time taken per unit recording area of the sheet in a conveyance direction, wherein the curl amount acquiring unit acquires the curl amount from the ink amount and the recording time taken per unit recording area.

4. The apparatus according to claim 3, wherein the time acquiring unit calculates the recording time from one of or a combination of two or more of a conveyance amount and a conveyance speed in one conveyance operation, a scanning speed and a scanning distance of the carriage, and a number of scanning times per unit recording area.

5. The apparatus according to claim 3, further comprising:

an elapsed-time counting unit configured to count elapsed time from the start of the recording operation, wherein the curl amount acquiring unit acquires the curl amount from the ink amount and the elapsed time.

6. The apparatus according to claim 3, wherein the ink amount acquiring unit acquires the ink amount per unit area according to a dot number recorded per unit time.

7. The apparatus according to claim 3, wherein the ink amount acquiring unit detects the ink amount per unit area by an object unit, by a specific print code, or by a number of specific codes.

8. The apparatus according to claim 1, wherein the control unit changes the time taken from the start to the point when the leading edge reaches the predetermined position by one of or a combination of two or more of a change in a scanning speed of the carriage, a change in a conveyance speed, a change in a lapse of time taken from completion of one scan to a start of conveyance, a change in a lapse of time taken from completion of the conveyance to a start of the scan, and a change in a number of nozzles of the recording head used for the recording operation.

9. The apparatus according to claim 1, further comprising:

a pair of rollers configured to nip and convey the sheet to a downstream side in a conveyance direction of the carriage, wherein the predetermined position is a position where the leading edge enters a nip of the rollers.

10. The apparatus according to claim 1, further comprising:

a discharge tray configured to stack the sheet on which the recording operation is performed, wherein the predetermined position is a position where the leading edge reaches the discharge tray.

11. The apparatus according to claim 10, further comprising:

a pair of rollers configured to nip and convey the sheet to a downstream side in a conveyance direction of the carriage, wherein the predetermined recording area is an area on which the recording operation is performed from a point when the leading edge is nipped to a point when the leading edge reaches the discharge tray.

12. An apparatus comprising:

a conveyance unit configured to convey a sheet;

a carriage configured to support and cause a recording head to scan for performing a recording operation on the conveyed sheet;

a curl amount acquiring unit configured to acquire a curl amount which is generated on the sheet when a leading edge of the sheet reaches a predetermined position, based on information regarding a recording condition of a predetermined recording area of the sheet on which the recording operation is performed; and a control unit configured to control the recording operation such that, when the acquired curl amount is a first curl amount, the time taken from a start of the recording operation on the predetermined recording area to a point when the leading edge reaches the predetermined position is increased more than when the curl amount is a second curl amount that is smaller than the first curl amount.

13. The apparatus according to claim 12, wherein the start is a point when the recording head starts the scan for the recording operation on the predetermined recording area.

14. An apparatus comprising:

a conveyance unit configured to convey a sheet;

a carriage configured to support and cause a recording head to scan for performing a recording operation on the conveyed sheet;

an ink amount acquiring unit configured to acquire an ink amount which is ejected to a predetermined recording area of the sheet on which the recording operation is performed until a leading edge of the recording sheet reaches the predetermined position; and a control unit configured to control the recording operation such that, when the acquired ink amount is a first amount, time taken from a start of the recording operation on the predetermined recording area to a point when the leading edge reaches the predetermined position is increased more than when the ink amount is a second amount that is smaller than the first amount.

15. The apparatus according to claim 14, wherein the start is a point when the recording head starts the scan for the recording operation on the predetermined recording area.

16. The apparatus according to claim 14, wherein the control unit changes the time taken from the start to the point when the leading edge reaches the predetermined position by one of or a combination of two or more of a change in a scanning speed of the carriage, a change in a conveyance speed by the conveyance unit, a change in a lapse of time taken from completion of one scan to a start of conveyance, a change in a lapse of time taken from completion of the conveyance to a start of the scan, and a change in a number of nozzles of the recording head used for the recording operation.

17. The apparatus according to claim 14, further comprising:

a pair of rollers configured to nip and convey the sheet to a downstream side in the conveyance direction of the carriage, wherein the predetermined position is a position where the leading edge enters a nip of the rollers.

18. The apparatus according to claim 14, further comprising:

a discharge tray configured to stack the sheet on which the recording operation is performed, wherein the predetermined position is a position where the leading edge reaches the discharge tray.

19. The apparatus according to claim 18, further comprising:

a pair of rollers configured to nip and convey the sheet to a downstream side in the conveyance direction of the carriage, wherein the predetermined recording area is an area on which the recording operation is performed from a point when the leading edge is nipped to a point when the leading edge of the sheet reaches the discharge tray.

20. The apparatus according to claim 14, wherein the ink amount acquiring unit acquires the ink amount per unit area according to a dot number recorded per unit time.

21. The apparatus according to claim 14, wherein the ink amount acquiring unit detects the ink amount per unit area by an object unit, by a specific print code, or by the number of specific codes.

* * * * *